US007670392B2

(12) United States Patent
Correa et al.

(10) Patent No.: US 7,670,392 B2
(45) Date of Patent: Mar. 2, 2010

(54) ENVIRONMENTALLY SAFE CHARCOAL-BASED HEAT SOURCE

(75) Inventors: Felipe Correa, 6000 Shephard Mountain Cove #114, Austin, TX (US) 78730; Tom McDowall, Austin, TX (US); Philip Leveridge, Austin, TX (US)

(73) Assignee: Felipe Correa, Austin, TX (US)

( * ) Notice: Subject to any disclaimer, the term of this patent is extended or adjusted under 35 U.S.C. 154(b) by 995 days.

(21) Appl. No.: 11/212,033

(22) Filed: Aug. 25, 2005

(65) Prior Publication Data

US 2007/0044377 A1 Mar. 1, 2007

(51) Int. Cl.
*C10L 11/00* (2006.01)
*A47J 37/07* (2006.01)
*C10L 11/06* (2006.01)

(52) U.S. Cl. ..... 44/530; 44/531; 44/532; 44/533; 44/534

(58) Field of Classification Search ..... 44/40, 44/530, 263, 531, 532, 533, 534; 126/25
See application file for complete search history.

(56) References Cited

U.S. PATENT DOCUMENTS 1,536,692 A * 5/1925 Scheu ..... 126/59.5
2,863,741 A * 12/1958 Sorgi ..... 44/506
3,177,826 A * 4/1965 Cohen ..... 126/25 B
3,262,765 A * 7/1966 Wimmer ..... 44/271
3,838,989 A * 10/1974 Cohn ..... 206/104
4,503,835 A * 3/1985 Williams ..... 126/25 B
4,567,070 A * 1/1986 Karass ..... 229/117.13
4,953,533 A * 9/1990 Witt ..... 126/25 B
6,328,028 B1 * 12/2001 Cayse et al. ..... 126/25 R
2008/0000467 A1 * 1/2008 Dudley et al. ..... 126/25 B

FOREIGN PATENT DOCUMENTS

WO WO01/67936 * 9/2001

* cited by examiner

*Primary Examiner*—Ellen M McAvoy
*Assistant Examiner*—Ming Cheung Po
(74) *Attorney, Agent, or Firm*—Hulsey Intellectual Property Lawyers, P.C.

(57) ABSTRACT

An environmentally-safe, disposable, and combustible charcoal-based heat source includes a first chimney structure and a second wall structure surrounding the chimney structure. An inner chimney flue receives air for igniting and burning the charcoal-based heat source and an outer chimney flue exhausts combustion fumes from the charcoal-based heat source. A bottom wall member secures to the inner chimney flue and the outer chimney flue and forms of a combustible material to be consumed during the ignition and burning of the charcoal-based fuel. A top wall member secures to the inner chimney flue and the outer chimney flue to be consumed during the ignition of the charcoal-based fuel. A plurality of exhaust apertures are arranged within the top wall for exhausting the combustion fumes from the outer chimney flue. An ignition ring establishes a sustained ignition of sufficient duration to ignite uniformly the charcoal-based fuel. A plurality of flaps provide an initial ignition of the ignition ring. The inner chimney flue, the outer chimney flue, the plurality of exhaust apertures, the flaps and the ignition lattice cooperating to provide uniform and rapid burning of the charcoal-based fuel.

20 Claims, 4 Drawing Sheets

ENVIRONMENTALLY SAFE CHARCOAL-BASED HEAT SOURCE

TECHNICAL FIELD OF THE DISCLOSURE

The subject matter relates generally to a heat source and a method of using the heat source that controls a prolonged and continuous burning of charcoal without the use of a lighting fluid or other igniting aid.

BACKGROUND OF THE DISCLOSURE

Backyard barbequing of meat and other foods provides an excellent way to enjoy the very best of smoked food preparation. One popular way to achieve the smoky flavor that barbequing makes possible uses charcoal or charcoal briquettes as the heat source. These heat sources are ignited and allowed to burn for a period of time after which the cooks uses their embers to smoke cook the food. Unfortunately, traditional methods for igniting charcoal require the use of an igniting fluid or similar aid to burn for a sufficiently long time for the charcoal to light.

The main problems with lighting fluid or similar aids include the likelihood that the lighting fluid or at least fumes from the lighting fluid will penetrate into the cooking food. Also, lighting fluid is itself an environmental pollutant. Still another frustrating aspect of lighting fluid is that the user generally must be carrying the lighting fluid as a separate, dangerously combustible item.

Yet another frustration occurs when the user applies either too much or too little lighting fluid. If too much fluid is used a large, uncontrollable and dangerous fire may result. If too little is used, the charcoal may not begin a self-sustaining burn prior to depleting the applied fluid. Furthermore, if the user applies new fluid to an active fire or smoldering ember, a further uncontrollable combustion may result.

All of these limitations suggest the need for a way to achieve the same igniting of charcoal for barbequing and the like without the need to use a lighting fluid.

Accordingly, there is the need for way to light charcoal or similar substances for barbequing and the like that avoids the use of lighting fluid.

There is the need for a clean or non-polluting way to light charcoal or similar substances that does not affect the cooking food.

Others in the prior art have attempted in various ways to promote the uniform heating of charcoal through orienting the charcoal in a vertical stack within the combustible package. The combustible package in such applications is constructed to be vertically upstanding, thereby orienting the charcoal to be vertically stacked around a central flue. As the combustible package is consumed, combustion gasses flow up through the central flue, providing for the heating of the charcoal from the center. The central flue also promotes the self-feeding of the charcoal into the center as the central flue is consumed by the fire. However, the central flue concentrates the heat of the fire within the center of the charcoal stack only, thus neglecting the outer edges of the charcoal.

Another approach attempts to extend the flue across the width of the combustible package, thereby increasing the quantity of charcoal affected by the centrally concentrated heat. This approach provides a second compartment beneath the stack of charcoal for containing an igniter for igniting the fire. Again, this configuration's use of the combustion gases neglects the outer perimeter of the charcoal.

Yet another approach attempts, but fails to address the charcoal along an outer perimeter. Such a configuration provides a combustible package that includes a generally octagonal platform, a centrally located chimney, a wall attached to the platform's perimeter, and an igniter. Along the platform's base are a number of holes that seek to draw air into the perimeter. While this configuration may provide a modest improvement over prior art devices, it fails to either provide a sustainable or a truly rapid heating of the charcoal. Because the package has no mechanism to assure that the package will sustain a flame for any period of time, the package may burn either completely or to a point where no further igniting combustion occurs. The result is simply hot, but unlit charcoal. In addition, because the holes at the platform base simply draw in ambient air into the charcoal peripheral chamber, the effect may, in fact, be to not provide the sought-after igniting at all.

As can be appreciated from the above, the prior art has not succeeded in providing a self=igniting combustion package which uses the full potential of the heat generated by the incipient flame for purpose s of preheating a quantity of charcoal.

Therefore, what is needed is a simple, combustible package having a built-in igniter and which provides for the uniform heating of a quantity of charcoal by concentrating the combustion heat not only beneath and at the center of the quantity of charcoal, but also along the perimeter of the charcoal.

There is a further need for a way to ignite charcoal or similar substances for heating or cooking that provides for a sustained burning of the heating substance.

A need exists for a way to ignite charcoal or similar substances that avoids the need to also use a lighting fluid.

Still a need exists for a way to ignite and burn charcoal and similar heating substances that provides a truly biodegradable or non-polluting alternative to polluting or contaminating situation which happens with the use of lightning fluid or similar substances.

BRIEF DESCRIPTION OF THE FIGURES

For a more complete understanding of the present disclosure, and the advantages thereof, reference is now made to the following brief descriptions taken in conjunction with the accompanying FIGUREs, in which like reference numerals indicate like features.

SUMMARY

Figure 1:
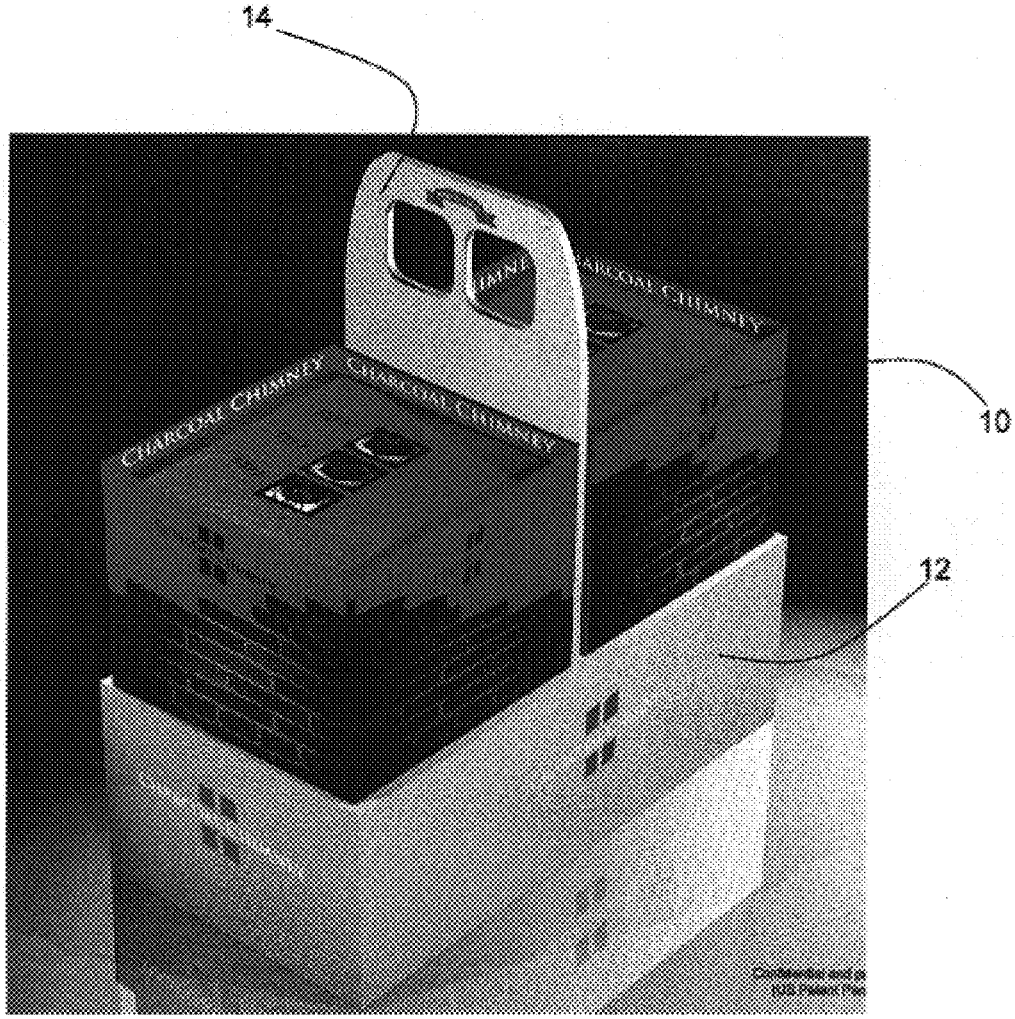
FIG. 1 is an illustration of an exemplary embodiment of the charcoal-based heat source of the disclosed subject matter including a carrying container as such may be sold.

Techniques for making and using an environmentally safe charcoal-based heat source are disclosed, which techniques improve both the cooking enjoyment of barbequed foods. The apparatus and methods here disclosed result in reduced environmental pollutants and a safer, more reliable charcoal burning experience for many different types of barbeque cooking applications.

The disclosed subject matter, therefore, provides an environmentally-safe, disposable, and combustible charcoal-based heat source includes a first chimney structure and a second wall structure surrounding the chimney structure. An inner chimney flue receives air for igniting and burning the charcoal-based heat source and an outer chimney flue exhausts combustion fumes from the charcoal-based heat source. A bottom wall member secures to the inner chimney flue and the outer chimney flue and forms of a combustible material to be consumed during the ignition and burning of the charcoal-based fuel. A top wall member secures to the inner chimney flue and the outer chimney flue to be consumed during the ignition of the charcoal-based fuel. A plurality of exhaust apertures are arranged within the top wall for exhausting the combustion fumes from the outer chimney flue. An ignition ring establishes a sustained ignition of sufficient duration to ignite uniformly the charcoal-based fuel. The inner chimney flue, the outer chimney flue, the plurality of exhaust apertures and the ignition lattice cooperating to provide uniform and rapid burning of the charcoal-based fuel.

These and other advantages of the disclosed subject matter, as well as additional novel features, will be apparent from the description provided herein. The intent of this summary is not to be a comprehensive description of the Claimed subject matter, but rather to provide a short overview of some of the subject matter's functionality. Other systems, methods, features and advantages here provided will become apparent to one with skill in the art upon examination of the following FIGUREs and detailed description. It is intended that all such additional systems, methods, features and advantages be included within this description, be within the scope of the accompanying Claims.

DETAILED DESCRIPTION

This disclosure provides a long-burning charcoal-based heat source that requires no lighting fluid or similar igniting aid for either initial or sustained burning.

It is an object of the present disclosure to provide a simple, combustible package for facilitating the combustion of a quantity of charcoal or similar combustible material for the general purposes of outdoor cooking.

It is a further object of this disclosure that such combustible package use the heat generated by combustion to uniformly heat the quantity of charcoal to be burned, thereby encouraging combustion and minimizing time required to ready the charcoal for cooking.

Yet a further object of the present disclosure is to provide a combustible package that includes a self-contained igniter for eliminating any need for petroleum-based flame accelerators.

It is a further object of the present invention to provide a package of charcoal package having a chimney there through in which the chimney is so shaped that as the material thereof burns away, and in so doing the chimney will draw combustion air into the combustible package and exhaust the fumes from igniting the charcoal to thus take advantage of the greater heat which occurs from producing the conducting air patch of ambient air, while provide heated combustion air and flame for igniting the charcoal around the inner chimney flue. At the bottom of the inner chimney flue an ignition ring, also of a non-polluting combustible material, maintains a flame that assures the charcoal will light during the burning of the combustion package. Because of a number of apertures positioned above the charcoal a secondary exhaust chimney results, a conductive path for the hot exhaust fumes results. This causes a more rapid and more reliable burning of the charcoal.

Still another object of the present disclosure is the provision of a charcoal package in which charcoal will be fed automatically into the part of the burning assemblage which is the hottest, whereby to promote the ignition of the charcoal.

FIG. 1 is an illustration of an exemplary embodiment of the charcoal-based heat sources 10 of the disclosed subject matter including a carrying container 12 as such may be sold. Carrying container 12 includes, in the disclosed instance, two charcoal-based heat sources 10. Using handle 14, a purchaser may carry the two charcoal-based heat sources 10.

Figure 2:
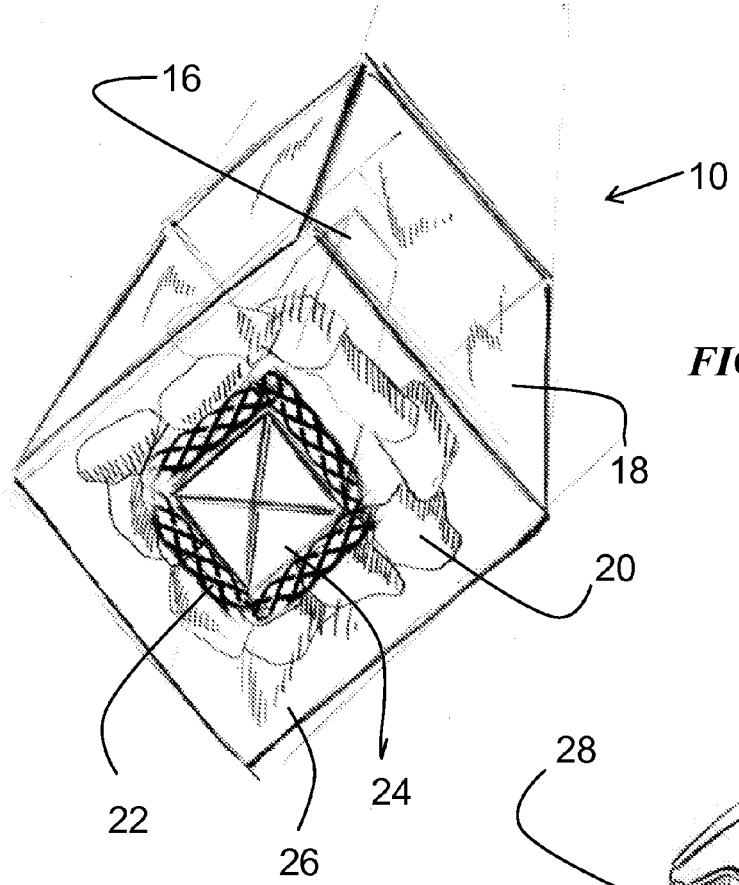
FIGS. 2 through 5 depict various stages in the initial use of the disclosed subject matter.

FIGS. 2 through 5 depict the construction and various stages in the initial use of charcoal-based heat source 10. Referring to FIG. 2, charcoal-based heat source 10 includes inner chimney 16, which is surrounded by outer wall 18. Charcoal or briquettes 20 surround inner chimney 16 and are enclosed by outer wall 18. Ignition ring 22, which may be a lattice or other structure surrounds inner chimney 16. For promoting ignition of inner chimney 16, flaps 24 may be introduced into the base 26 of heat source 10. The result, therefore, is an integrated and economical ignition system including inner chimney 16, outer wall 18, ignition ring 22, and flaps 24.

Figure 3:
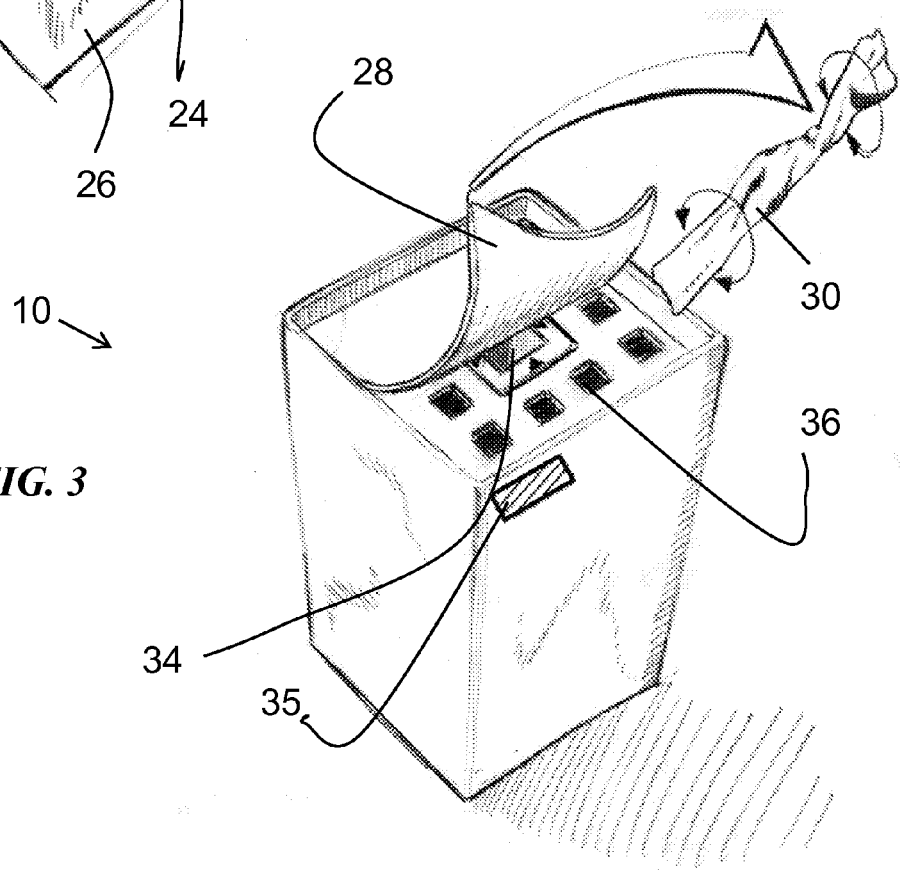
Figure 4:
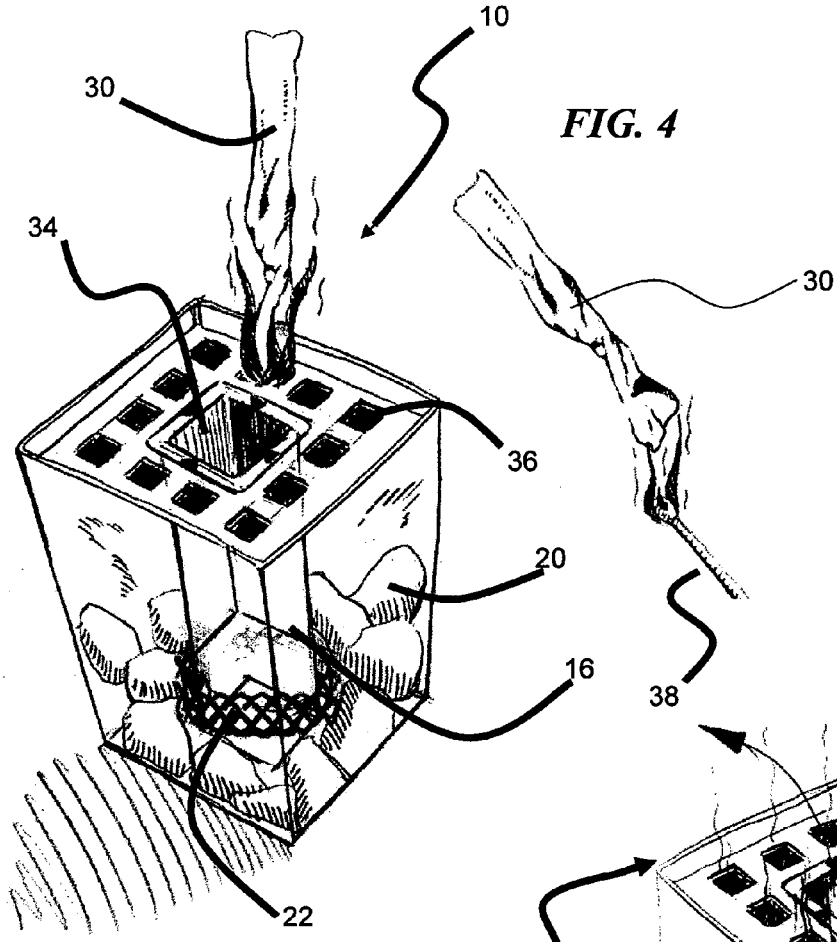

FIG. 3 shows charcoal-based heat source 10 to include top cover 28, which when removed and twisted becomes igniter 30. Also, at the top 32 of heat source 10 appears inner chimney opening 34 and exhaust apertures 36. Striking surface 35 is shown located at the top of the package structure. FIG. 4 shows the use of igniter 30 that, upon being lit by match 38, provides the flame source that may be dropped down into inner chimney opening 34. Upon being dropped down inner chimney opening 34, inner chimney 16, ignition ring 22, charcoal 20, and flaps 24 may all ignite.

Figure 5:
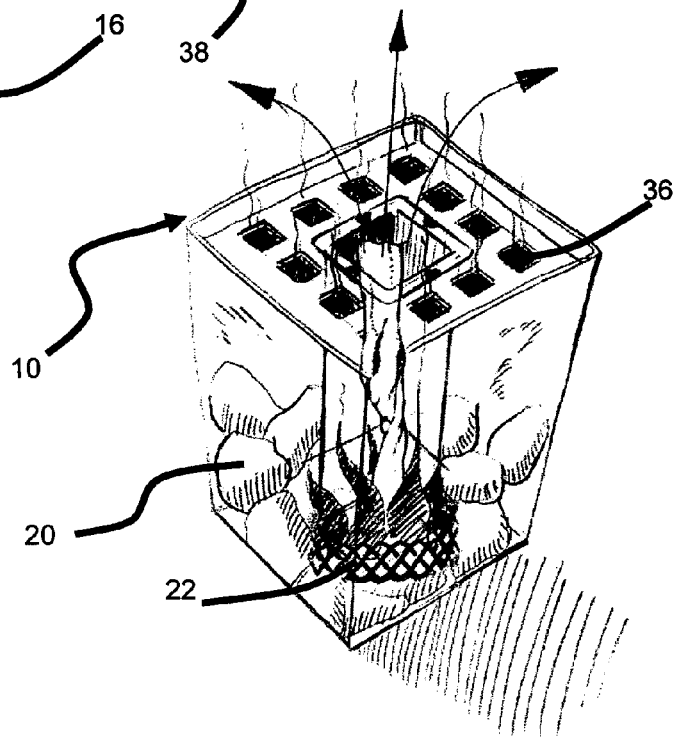
Figure 6:
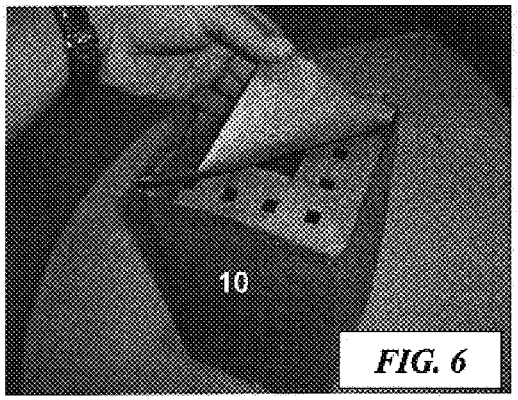
FIGS. 6 through 11 portray an exemplary full use of one embodiment of the disclosed subject matter.
Figure 7:
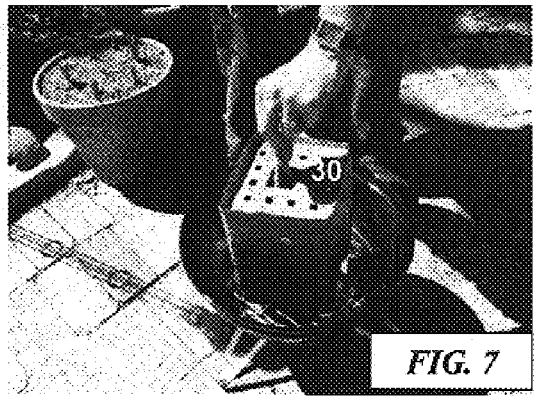
Figure 8:
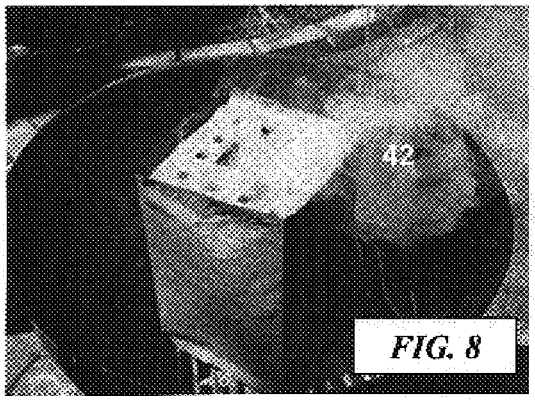
Figure 9:
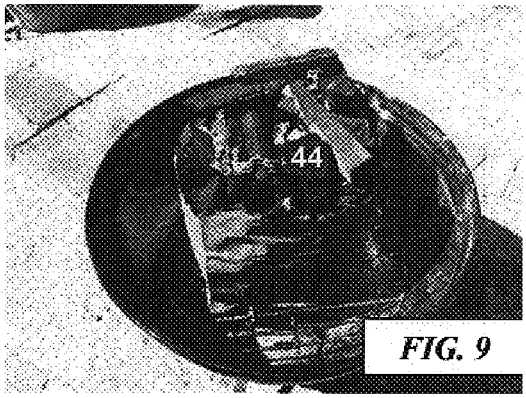

As FIG. 5 shows, igniter 30 cover does not immediately light ignition ring 22. Instead, igniter 30, lights the flaps 24 on base 26 and inner chimney 16. As these portions of heat source 10 burn back, then ignition ring 22 begins to burn. Ignition ring 22 actually increases the rate of burn, causing charcoal 20 to smolder, burn, and achieve a reliable, sustained fire for barbecuing.

Figure 10:
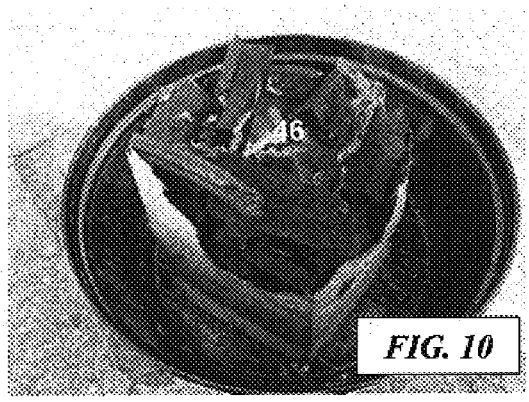
Figure 11:
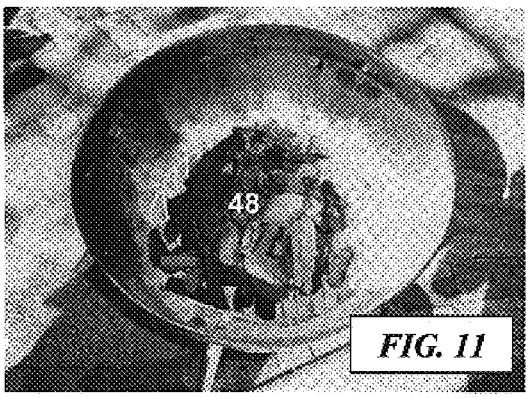

FIGS. 6 through 11 show an exemplary use of one embodiment of the disclosed subject matter for heat source 10. In particular in FIG. 6, heat source 10 maybe placed in a barbeque grill 40. Upon being ignited using igniter 30, FIG. 7, heat source 10 begins to smolder as fumes 42, FIG. 8. Thereafter, inner chimney 16 and ignition ring 22 begins to burn, this action draws combustion air into inner chimney 16 and exhausts combustion fumes from exhaust apertures 36. As heat source 10 continues to further burn, the exterior walls of heat source 10 burn away exposing charcoal stack 44, FIG. 9. However, as FIG. 10 shows, a sustained and glowing fire 46 exists within heat source 10. FIG. 11 shows the final result of heat source 10 use, i.e., evenly and completely burned charcoal 48.

The disclosed subject matter, therefore, provides an environmentally-safe, disposable, and combustible charcoal-based heat source that includes a first combustible inner, vertical, upright chimney structure, and a second combustible, outer, vertical, upright wall structure surrounding the chimney structure. An inner chimney flue is defined by the chimney structure for receiving air for igniting and burning the charcoal-based heat source. An outer chimney flue is defined by the outer wall of the first combustible inner, vertical, upright chimney structure and the inner wall of the second combustible, outer vertical, upright wall structure, the outer chimney for exhausting combustion fumes from the charcoal-based heat source.

A bottom wall member is secured to the inner chimney flue and the outer chimney flue and formed of a combustible material so as to be consumed during the ignition and burning of the charcoal-based fuel. A top wall member is secured to the inner chimney flue and the outer chimney flue and formed of a combustible material so as to be consumed during the ignition of the charcoal-based fuel. A plurality of exhaust apertures are arranged within the top wall for exhausting the combustion fumes from the outer chimney flue. An ignition ring associates with the bottom of the inner chimney flue and the bottom of the outer chimney flue, the ignition ring for establishing a sustained ignition of sufficient duration to ignite uniformly the charcoal-based fuel. The inner chimney flue, the outer chimney flue, the plurality of exhaust apertures and the ignition lattice cooperating to provide uniform and rapid burning of the charcoal-based fuel.

Heat source 10 may be formed in its entirety of a biodegradable material, the ashes of which likewise may biodegrade. Heat source 10, therefore, improve on existing packaging, lighting, and handling of bagged barbecue charcoal by implementing a single-use system that provides ease of use, added safety and a more environmentally sensitive product. Heat source 10 works with most types of bagged charcoal including briquettes and lump charcoal.

Heat source 10 may be made of a paperboard material, a corrugated cardboard material, or any other economical stiff material that provides the desired level of combined combustion and strength to achieve the purposes of the present disclosure. The charcoal-based fuel provides a single-use amount of a charcoal material. The charcoal-based fuel may or may not be treated with a flammable substance to enhance combustion. A fire starter associated with the top wall member, the top wall comprising a cover for the plurality of apertures and permitting removal from the apertures in the use of the fire starter. A sulfur-based match surface may associate with the fire starter for striking on a surface, thereby causing the fire starter to function as a self-igniting match. Also, a striking surface may associate with the top wall for providing surface for striking the sulfur-based match surface. The heat source may also include an over wrap for substantially encircling the heat source for providing a for graphics, content, advertising, instructions or coupons. Furthermore, the heat source may be packaged in a carton for holding a plurality of the heat sources, the carton comprising a handle for carrying the plurality of the heat sources.

One particularly advantageous aspect of heat source 10 includes the ability to be formed from comparatively inexpensive materials using comparatively inexpensive and efficient manufacturing techniques. Thus, while prior combustible heat sources may include some of the novel features of the disclosed subject matter, none show the desirable attributes of heat source 10 that may be formed of pre-fabricated cardboard or similar flat material from which both inner chimney 16 all the outer walls of heat source 10 may be formed. Moreover, the novel ignition ring 22 may also be formed of an in expensive, combustible, pre-fabricated material. As a result of these advantages, the disclosed subject matter prorate, a self-igniting combustible heat source 10 that may be competitively priced with all existing charcoal bags all other modes of displaying and selling charcoal and with all of the technical features here described. This technical advantage alone fully distinguishes the disclosed heat source 10 from all prior such devices.

The use of the terms "a" and "an" and "the" and similar referents in the context of describing embodiments of the subject matter (especially in the context of the following Claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the subject matter and does not pose a limitation on the scope of the subject matter. No language in the specification should be construed as indicating any non-described element as essential to the practice of the subject matter.

Preferred embodiments of this subject matter are described herein, including the best mode known to the inventors for carrying out the subject matter. Variations of those preferred embodiments may become apparent to those of ordinary skill in the art upon reading the foregoing description. The inventors expect skilled artisans to employ such variations as appropriate, and the inventors intend for the subject matter to be practiced otherwise than as specifically described herein. Accordingly, this subject matter includes all modifications and equivalents of the subject matter as permitted by applicable law. Moreover, any combination of the above-described elements in all possible variations thereof is encompassed by the subject matter unless otherwise indicated herein or otherwise clearly contradicted by context.

We claim:

1. An environmentally-safe, disposable, and combustible charcoal-based heat source, comprising:

a first combustible inner, vertical, upright chimney structure, and a second combustible, outer, vertical, upright wall structure surrounding said chimney structure;

an inner chimney flue defined by said chimney structure for receiving air for igniting and burning said charcoal-based heat source;

an outer chimney flue defined by the outer wall of said first combustible inner, vertical, upright chimney structure and the inner wall of said second combustible, outer vertical, upright wall structure, said outer chimney for exhausting combustion fumes from said charcoal-based heat source located within said outer chimney flue;

a bottom wall member secured to said inner chimney flue and said outer chimney flue and formed of a combustible material so as to be consumed during the ignition and burning of a charcoal-based fuel;

a top wall member secured to said inner chimney flue and said outer chimney flue and formed of a combustible material so as to be consumed during the ignition of a charcoal-based fuel;

a plurality of exhaust apertures arranged within said top wall member for exhausting said combustion fumes from said outer chimney flue;

an ignition ring associating with the bottom of said inner chimney flue and the bottom of said outer chimney flue and located above said bottom wall member and below said charcoal-based fuel, said ignition ring for establishing a sustained ignition of sufficient duration to ignite uniformly the charcoal-based fuel;

a plurality of flaps associated with said inner chimney flue for transferring a flame from an igniter placed inside of said inner chimney flue to said ignition ring; and said inner chimney flue, said outer chimney flue, said plurality of exhaust apertures, said flaps, and said ignition ring cooperating to provide uniform and rapid burning of said charcoal-based fuel.

2. The heat source of claim 1, wherein the heat source comprises a pre-fabricated paperboard material.

3. The heat source of claim 1, wherein said heat source comprises a pre-fabricated corrugated cardboard material.

4. The heat source of claim 1, wherein said charcoal-based fuel comprises a single-use amount of a charcoal material.

5. The heat source of claim 1, further comprising a fire starter associated with said top wall member, said top wall comprising a cover for said plurality of apertures and permitting removal from said apertures in the use of said fire starter.

6. The heat source of claim 5, further comprising a sulfur-based match surface associated with said fire starter for striking on a surface, thereby causing said fire starter to function as a self-igniting match.

7. The heat source of claim 6, further comprising a striking surface associated with said top wall for providing surface for striking said sulfur-based match surface.

8. The heat source of claim 1, further comprising an over wrap for wholly or partially encircling said heat source for providing a medium for graphics, content, advertising, instructions or coupons.

9. The heat source of claim 1 wherein said charcoal-based heat source is treated with a flammable substance to enhance combustion.

10. The heat source of claim 1, further comprising a carton for holding a plurality of said heat sources, said carton comprising a handle for carrying said plurality of said heat sources.

11. A method for forming an environmentally-safe, disposable, and combustible charcoal-based heat source, comprising:

forming a first combustible inner, vertical, upright chimney structure, and a second combustible, outer, vertical, upright wall structure surrounding said chimney structure;

forming an inner chimney flue defined by said chimney structure for receiving air for igniting and burning said charcoal-based heat source;

forming an outer chimney flue defined by the outer wall of said first combustible inner, vertical, upright chimney structure and the inner wall of said second combustible, outer vertical, upright wall structure, said outer chimney for exhausting combustion fumes from said charcoal-based heat source located within said outer chimney flue;

forming a bottom wall member secured to said inner chimney flue and said outer chimney flue and formed of a combustible material so as to be consumed during the ignition and burning of a charcoal-based fuel;

forming a top wall member secured to said inner chimney flue and said outer chimney flue and formed of a combustible material so as to be consumed during the ignition of a charcoal-based fuel;

forming a plurality of exhaust apertures arranged within said top wall member for exhausting said combustion fumes from said outer chimney flue;

forming an ignition ring associating with the bottom of said inner chimney flue and the bottom of said outer chimney flue and located above said bottom wall member and below said charcoal-based fuel, said ignition ring for establishing a sustained ignition of sufficient duration to ignite uniformly the charcoal-based fuel;

forming a plurality of flaps associated with said inner chimney flue for transferring a flame from an igniter placed inside of said inner chimney flue to said ignition ring; and associating said inner chimney flue, said outer chimney flue, said plurality of exhaust apertures and said ignition lattice to provide uniform and rapid burning of said charcoal-based fuel.

12. The heat source forming method of claim 11, further comprising the step of forming said heat source to comprise a pre-fabricated paperboard material.

13. The heat source forming method of claim 11, further comprising the step of forming said heat source from pre-fabricated corrugated cardboard material.

14. The heat source forming method of claim 11, further comprising the step of forming said charcoal-based fuel from a single-use amount of a charcoal material.

15. The heat source forming method of claim 11, further comprising the step of forming a fire starter associated with said top wall member, said top wall comprising a cover for said plurality of apertures and permitting removal from said apertures in the use of said fire starter.

16. The heat source forming method of claim 11, further comprising the step of forming a sulfur-based match surface associated with said fire starter for striking on a surface, thereby causing said fire starter to function as a self-igniting match.

17. The heat source forming method of claim 12, further comprising the step of forming a striking surface associated with said top wall for providing surface for striking said sulfur-based match surface.

18. The heat source forming method of claim 11, further comprising the step of forming an over wrap for wholly or partially encircling said heat source for providing a medium for graphics, content, advertising, instructions or coupons.

19. The heat source forming method of claim 11, further comprising the step of forming said charcoal fuel particles to include a treatment with a flammable substance to enhance combustion.

20. The heat source forming method of claim 11, further comprising the step of forming a carton for holding a plurality of said heat sources, said carton comprising a handle for carrying said plurality of said heat sources.

* * * * *